US005173942A

United States Patent [19]

Hirose

[11] Patent Number: 5,173,942

[45] Date of Patent: Dec. 22, 1992

[54] AUDIO SYSTEM OPERABLE IN DIRECTIONAL AND NON-DIRECTIONAL MODES

[75] Inventor: Isamu Hirose, Hiroshima, Japan

[73] Assignee: Sharp Kabushiki Kaisha, Osaka, Japan

[21] Appl. No.: 604,340

[22] Filed: Oct. 24, 1990

Related U.S. Application Data

[63] Continuation of Ser. No. 430,921, Nov. 1, 1989, abandoned, which is a continuation of Ser. No. 303,020, Jan. 27, 1989, abandoned, which is a continuation of Ser. No. 94,512, Sep. 9, 1987, abandoned.

[30] Foreign Application Priority Data

Sep. 13, 1986 [JP] Japan ..... 61-216219

[51] Int. Cl.[5] ..... H04R 1/02; H04R 25/00

[52] U.S. Cl. ..... 381/89; 381/98; 381/155; 381/160; 181/155

[58] Field of Search ..... 381/87-89, 381/98, 103, 155, 158, 160, 186; 181/145, 155, 185, 153, 144

[56] References Cited

U.S. PATENT DOCUMENTS

| | | | |
|---|---|---|---|
| 2,815,823 | 12/1957 | Olson et al. | 381/184 |
| 3,912,866 | 10/1975 | Fox | 181/155 |
| 4,182,931 | 1/1980 | Kenner | 181/144 |
| 4,348,549 | 9/1982 | Berlant | 181/155 |
| 4,348,750 | 9/1982 | Schwind | 181/155 |
| 4,356,881 | 11/1982 | Lowell | 181/155 |
| 4,379,951 | 4/1983 | Gabr | 381/186 |
| 4,477,699 | 10/1984 | Wada et al. | 381/185 |
| 4,610,024 | 9/1986 | Schulhof | 381/103 |
| 4,620,317 | 10/1986 | Anderson | 381/160 |
| 4,648,117 | 3/1987 | Kunugi et al. | 381/102 |

FOREIGN PATENT DOCUMENTS

| | | | |
|---|---|---|---|
| 562266 | 10/1932 | Fed. Rep. of Germany | 181/185 |
| 0970228 | 8/1958 | Fed. Rep. of Germany | 181/155 |
| 2325603 | 12/1974 | Fed. Rep. of Germany | 181/155 |
| 2433916 | 1/1976 | Fed. Rep. of Germany | 181/155 |
| 50-42761 | 12/1975 | Japan . | |
| 57-21198 | 2/1982 | Japan . | |
| 59-121991 | 2/1983 | Japan . | |
| 0035699 | 2/1986 | Japan | 381/160 |
| 508458 | 6/1939 | United Kingdom . | |
| 0653263 | 5/1951 | United Kingdom | 181/155 |
| 846591 | 8/1960 | United Kingdom . | |
| 1472963 | 5/1977 | United Kingdom . | |
| 2007461 | 5/1979 | United Kingdom . | |
| 2184323 | 6/1987 | United Kingdom . | |
| 01176 | 3/1985 | World Int. Prop. O. . | |

*Primary Examiner*—James L. Dwyer
*Assistant Examiner*—Wing F. Chan
*Attorney, Agent, or Firm*—Morrison & Foerster

[57] ABSTRACT

An audio system includes a speaker unit having an opening in its front surface supporting a speaker and a diffuser with a reflecting surface detachably attached to the speaker unit and positioned opposite to the speaker and in front of the opening such that sound waves from the speaker are diffused by the reflecting surface of the diffuser to propagate radially. A multi-channel amplifier for driving the speaker includes a compensating circuit for correcting the output level and frequency characteristic of the system when the diffuser is attached.

10 Claims, 5 Drawing Sheets

AUDIO SYSTEM OPERABLE IN DIRECTIONAL AND NON-DIRECTIONAL MODES

This is a continuation of application Ser. No. 430,921, filed Nov. 1, 1989, now abandoned, which is a continuation of application Ser. No. 303,020, filed Jan. 27, 1980, and now abandoned, which is a continuation of application Ser. No. 094,512 filed Sep. 9, 1987, and now abandoned.

BACKGROUND OF THE INVENTION

This invention relates to an audio system.

As shown in FIG. 7, a conventional stereo system includes at least two speaker units 33 and 34 containing speakers 31 and 32 and disposed horizontally separated from each other by a distance D such that a listener (not shown) will listen to the sounds from the speakers 31 and 32 by facing the speaker units 33 and 34 at a position on a line L6 which perpendicularly bisects the line segment L5 of length D connecting the front surfaces thereof. Since good acoustic effects are obtainable from the individual speakers 31 and 32 if the listener is positioned within the fan-shaped areas around their central axes L7 and L8, each subtending a certain angle a, good stereophonic effect is generally obtainable in the area A where the aforementioned two fan-shaped areas overlap with each other, or the area shaded in FIG. 7. If the listener is on the bisecting line L6 at a position indicated by P in FIG. 7, the minimum value of the distance F between the point P and the line segment L5 at which a good stereophonic effect may be expected depends on the transverse separation distance D between the speaker units 33 and 34 and the angle $\alpha$ determined by the speakers 31 and 32. The angle $\alpha$ depends partially on the speakers' diameter and may be about 30° if the diameter is 12 cm.

With a stereo system of the type described above, the area within which the sounds from the speakers 31 and 32 can be received well is extremely limited. On the other hand, there are frequently situations wherein it is desired to expand such preferred area, for example, such that listeners can enjoy good stereophonic sound effects anywhere within a certain radius from a single source as illustrated in FIG. 8 wherein numeral 41 indicates a single speaker having a central axis L8 defining the X axis of a coordinate system therearound, the Y axis being perpendicular thereto and passing through the position of the speaker 41 and letter B indicating a planar area defined by the X and Y axes. In other words, speakers which are non-directional within a plane are desired and if two or more of such speakers are appropriately positioned within a room, for example, persons can hear the sounds from these speakers distinctly from any position inside the room and enjoy different acoustical effects than those from a conventional stereo system. Nowadays, there are increased demands for such an audio system that can create a so-called "free acoustic space".

If the central axis of a single speaker is frontally directed to a listener, however, this does not amount to providing a non-directional speaker. In the past, there was a proposal for so-called non-directional spherical speakers having a plurality of speakers arranged inside a ball-shaped speaker unit such that sounds will be propagated in all directions from a center at the speaker unit. This proposal, however, was not well accepted because many speakers are required and this increases the overall production cost and also because such a system must be disposed and supported correctly for a good result and hence cannot be used easily.

SUMMARY OF THE INVENTION

It is therefore an object of the present invention to solve the aforementioned technical problems by providing an audio system of a simple structure with which each sound channel from the individual speakers can be distinctly received.

The above and other objects of the present invention can be achieved by providing an audio system comprising a multi-channel amplifier and at least two speaker units containing speakers which are individually driven by the outputs of this amplifier, and characterized wherein a diffuser is removably attached to the front surface of each of the speaker units opposite the speaker and wherein the amplifier includes a circuit for compensating its output level and frequency characteristic individually for these channels when the diffuser is used.

With an audio system thus structured, sound waves from each speaker are diffused by the reflecting surface of the diffuser and propagated radially within a plane perpendicular to the central axis of the speaker. Since the amplifier includes a circuit for correcting the level of sound pressure and frequency characteristic when the diffuser is used, furthermore, a non-directional audio system can be realized within a plane around the central axis of the speaker if this central axis is oriented in a certain direction. Since the diffuser is removably attached to the speaker unit, this system can be used also as a conventional speaker unit by removing the diffuser and orienting the central axis of the speaker in the direction of the listener.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
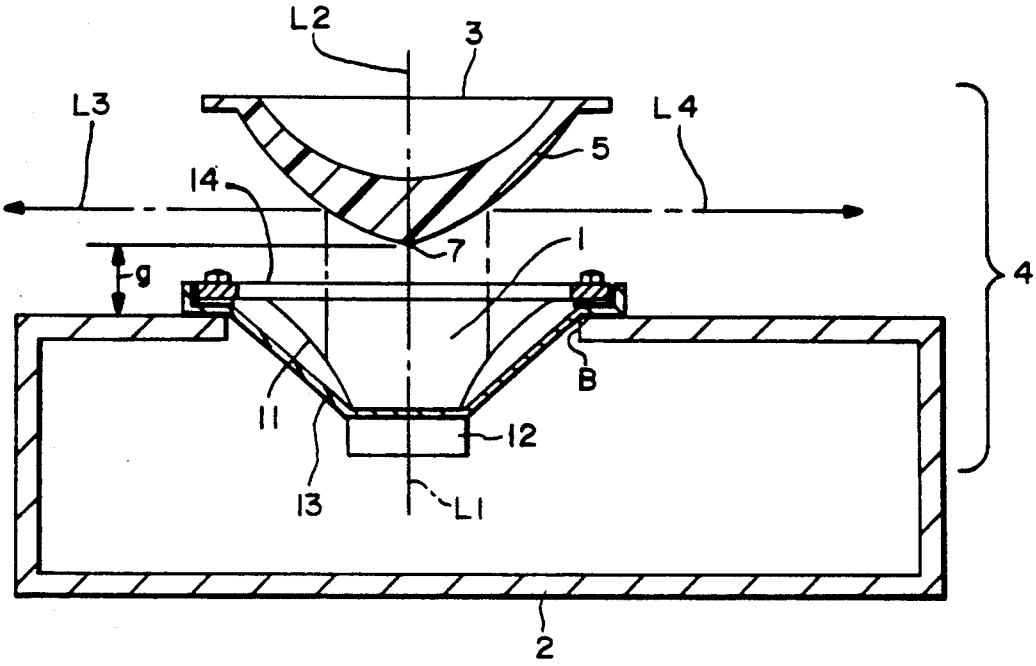
FIG. 1 is a sectional view of a speaker unit and a diffuser embodying the present invention.

With reference to FIG. 1, numeral 2 indicates a speaker unit having in its front surface an opening B in which is affixed a speaker 1 with a vibrating diaphragm 11 of corn paper defining a central axis L1, a driving magnet 12, a frame 13 and a frontal net 14. Numeral 3 indicates a diffuser with a reflecting surface 5. Although it is not so shown in FIG. 1, the diffuser 3 is also attached to the speaker unit 2, disposed in front of the opening section B of the speaker unit 2 opposite to the speaker 1 such that its central axis L2 coincides with the central axis L1 of the speaker 1 and that there is a predetermined separation distance of g between the front surface of the speaker unit 2 and the apex 7 of the diffuser 3. The distance g is to be determined, depending upon the diameter of the speaker 1, the diameter of the opening section B, etc. If the diameter of the speaker 1 is 12 cm, for example, g may be about 1 cm. The combination thus structured with a speaker unit and a diffuser is hereinafter referred to as a speaker system 4.

If the speaker system 4 is disposed with its front surface in the upward direction as shown in FIG. 1, sound waves from vibrating surface 11 of the speaker 1 are reflected by the reflecting surface 5 of the diffuser 3 such that the direction of their propagation is changed by 90° from the central axis L2 of the diffuser 3 as indicated by lines L3 and L4. Accordingly, the sound from the speaker 1 is propagated radially in outward directions with respect to the central axis L2, and this means that it functions as a non-directional speaker in a plane perpendicular to the central axis L2.

Figure 2:
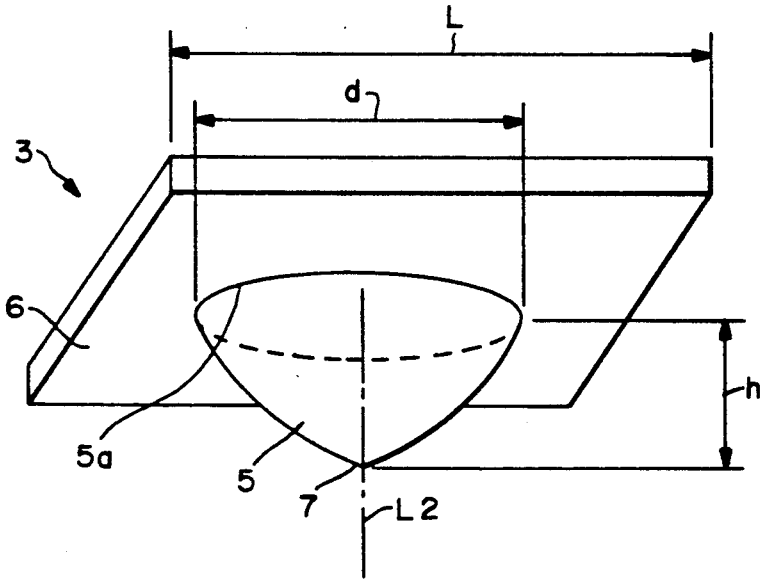
FIG. 2 is a diagonal view of a diffuser embodying the present invention.

The diffuser 3, shown also in FIG. 2, is formed unistructurally from a synthetic resin material such as high impact styrol. Numeral 6 indicates a base plate. Dimensions of the base plate 6 and the reflecting surface 5 depend on the size of the speaker 1 opposite thereto. For a diffuser adapted to be coupled to a speaker with diameter of 12 cm, the base plate 6 may be a square of size (represented by L) about 23 cm and the height h of the reflecting surface 5, that is, the vertical distance between the apex 7 and the surface of the base plate 6 may be about 4.2 cm. The diameter d of the base 5*a* of the reflecting surface 5 may be about 17.5 cm. The shape of the curved edge of the reflecting surface 5 may vary, depending on the aforementioned distance g between the speaker unit 2 and the diffuser 5 and also on the acoustic characteristic of the speaker unit 2. An optimum shape can be determined by a computer simulation on the basis of its actual structure and data obtained by tests on its characteristics.

Figure 3:
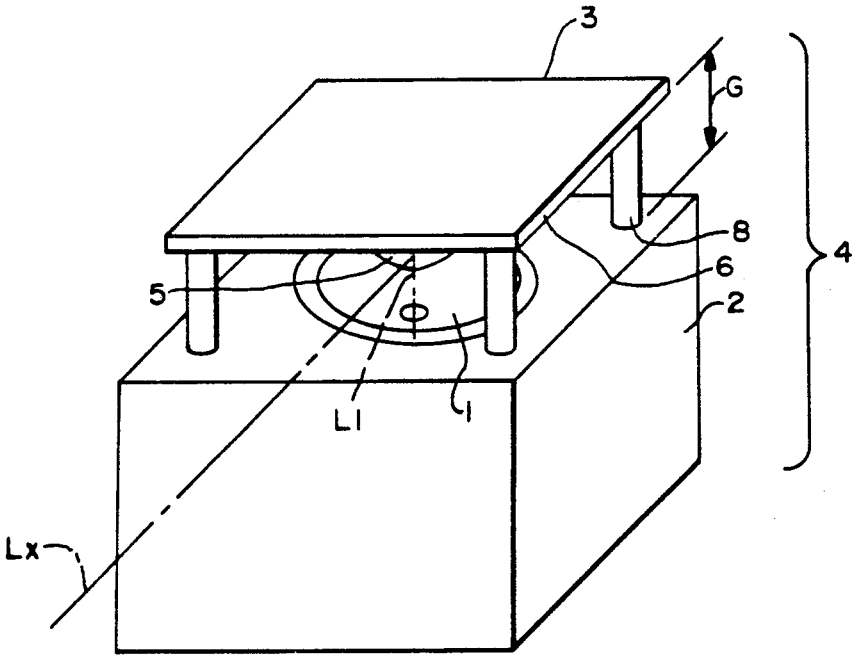
FIG. 3 is a diagonal external view of a speaker system embodying the present invention.

A preferred manner in which the diffuser 3 of FIGS. 1 and 2 is attached to form the speaker system 4 is illustrated in FIG. 3 wherein numeral 8 indicates pipes or pin-shaped members for detachably attaching the diffuser 3 to the front surface (pointing upward with reference to FIG. 3) of the speaker unit 2 with the base plate 6 (not shown in FIG. 1) such that a predetermined distance G is maintained as shown between the base plate 6 of the diffuser 3 and the front surface of the speaker unit 2 and that the speaker 1 and the diffuser 3 are substantially in coaxial relationship as shown in FIG. 1. It is to be noted that this speaker system 4 would be functioning like one of the conventional type if the diffuser 3 were removed and the central axis L1 of the speaker 1 were rotated by 90°, say, in the direction indicated by $L_x$. In other words, a conventional speaker system can be realized by using at least two speaker systems 4 shown in FIG. 3.

Figure 4:
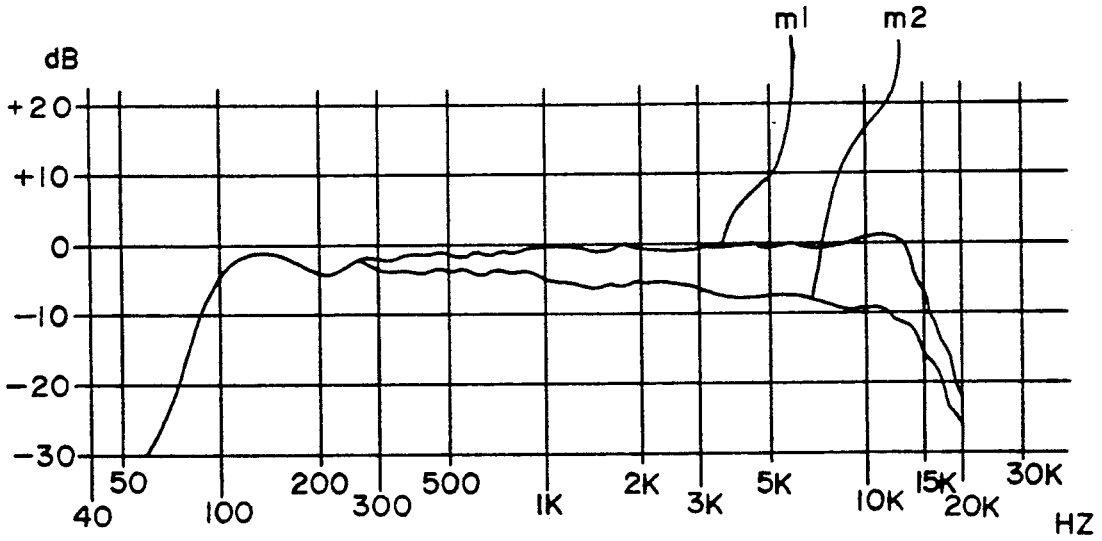
FIG. 4 is a graph showing the output characteristic of a speaker unit embodying the present invention.

FIG. 4 is a graph showing the output characteristics of a speaker unit embodying the present invention as measured by the present inventor. The horizontal axis of the graph represents the range of playback frequency (Hz) and its vertical axis represents the deviation from a reference level of acoustic pressure (0 dB). The first characteristic curve m1 represents the acoustic pressure level measured at a point 1 m away from the speaker 1 (with diameter of 12 cm) and on its central axis L1 pointing in the forward direction with the diffuser 3 removed from the speaker unit 2. The second characteristic curve m2 represents the acoustic pressure level measured at a point 1 m away from the speaker 1 and on the line $L_x$ shown in FIG. 3 with the diffuser 3 attached to the speaker unit 2 to make the system 4 non-directional. Although it is not clearly ascertainable from FIG. 3, the line $L_x$ is intended to be at equidistance both from the base plate 6 of the diffuser 3 and the upper surface of the speaker unit 2 and to intersect the central axis $L_1$ and $L_2$ of the diffuser 3 and the speaker 1. It is to be noted by comparing the two curves m1 and m2 in FIG. 4 that the output drops gradually in the higher range if the diffuser 3 is attached to the speaker unit 2 to provide a non-directional speaker system while the curve is relatively flat if the speaker 1 directly faces the front. For this reason, it is desirable to provide compensating circuits (not shown in FIGS. 1–3) for the amplifiers for all channels to correct this drop.

Figure 5:
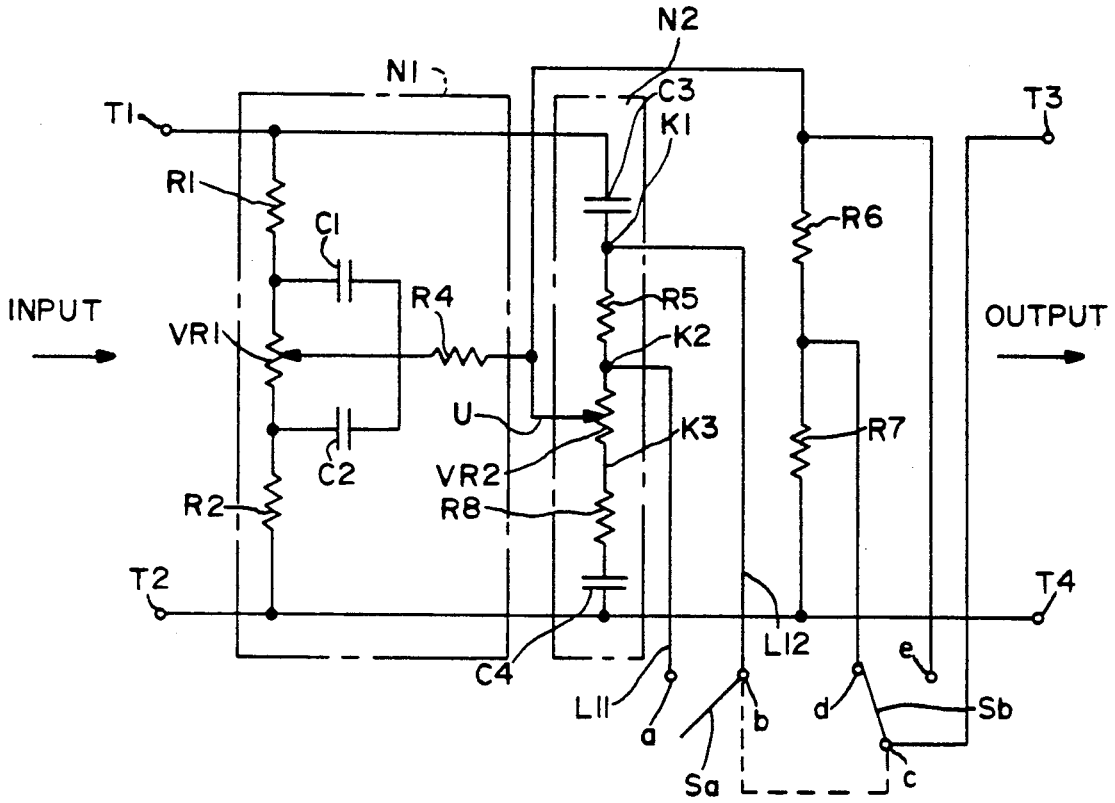
FIG. 5 is a circuit diagram of a compensating circuit embodying the present invention for each channel.
Figure 6:
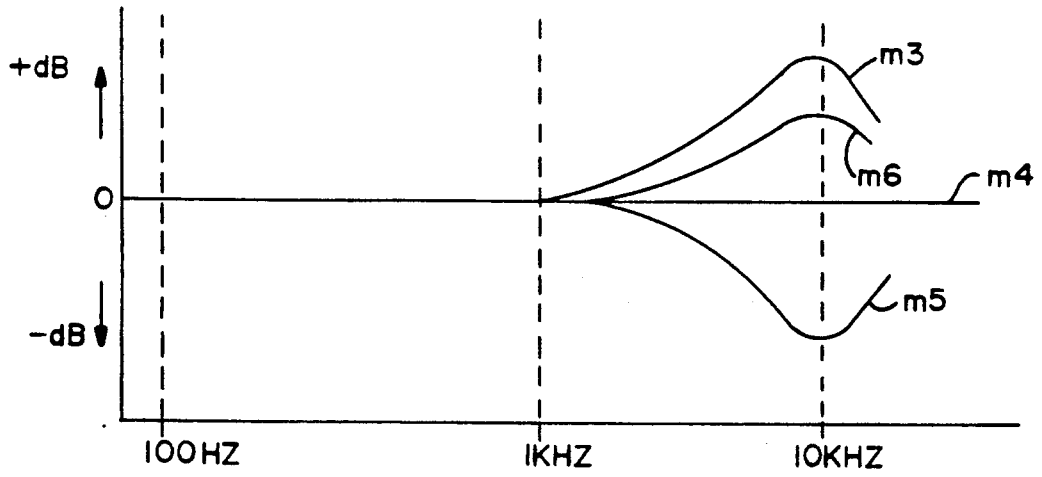
FIG. 6 is a graph showing the frequency characteristic of an amplifier.
Figure 7:
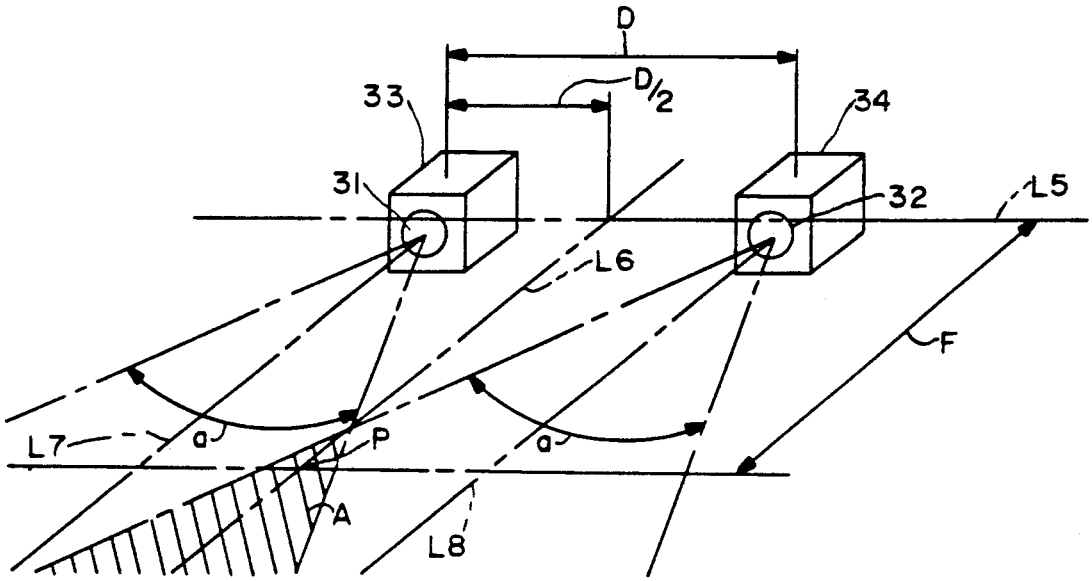
(PRIOR ART) FIG.—7
FIG. 7 is a drawing for showing the speaker arrangement in a conventional stereo system.
Figure 8:
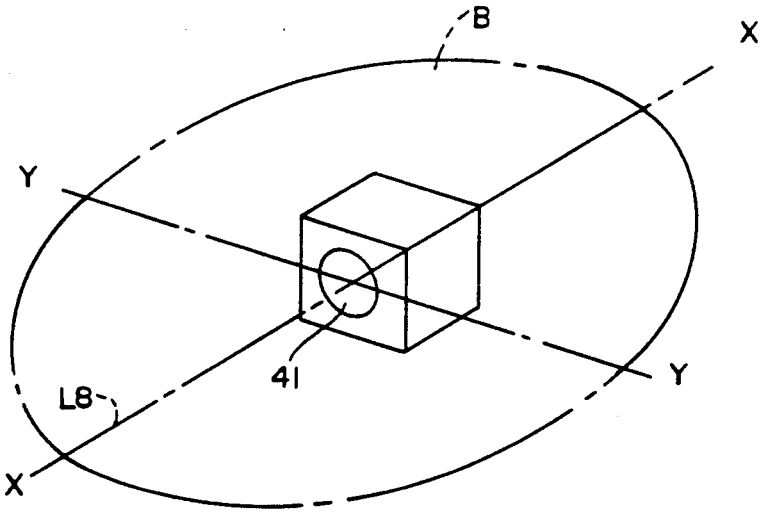
(PRIOR ART) FIG.—8
FIG. 8 is a drawing for showing an acoustic space created by a speaker.

FIG. 5 is a circuit diagram of such a compensating circuit for each channel and FIG. 6 is a graph for showing the frequency characteristic of an amplifier with the circuit shown in FIG. 5. The circuit shown in FIG. 5 is basically a tone-control circuit, capable of individually controlling the gains in low and high frequency ranges with reference to, say, 1 kHz. With reference to FIG. 5, the network N1 on the left-hand side including resisters R1, R2 and R4, capacitors C1 and C2 and a variable resister VR1 is for controlling the low frequency range and the network N2 on the right-hand side including resisters R5 and R8, capacitors C3 and C4 and a variable resister VR2 is for controlling the high frequency range. The series connection of resisters R6 and R7 forms a voltage dividing circuit for output levels.

The output level in the high frequency range is varied by adjusting the variable resister VR2 of the second network N2. As the slider U of this variable resister approaches its junction K2 with the resister R5, the output level in the high frequency range becomes higher and this is shown by the characteristic curve m3 in the graph of FIG. 6. If the slider U approaches the junction K3 with the resister R8, the output level drops and the characteristic curve will be as shown by the line m5. If the slider U is nearly at the midpoint of its variable range, the characteristic curve is flat as shown by the line m4.

If the resister R5 is shorted with the slider U at the aforementioned midpoint, on the other hand, a different characteristic curve as shown by the line m6 is obtained. In one test example, compensating circuits of this type were included in all amplifier channels with both ends of the resister R5 connected respectively through lines L11 and L12 to junction points a and b of a switch $S_a$, and the diffuser 3 was attached to realize a non-directional speaker system. A characteristic as shown by the curve m6 of FIG. 6 was obtained and the aforementioned drop in the output in the higher frequency range shown in FIG. 3 was thereby corrected. In another test example, a second switch $S_b$ interlocking with the first switch $S_a$ was provided and junctions c and e thereof were connected such that sound signals are directly delivered to output terminals T3 and T4 without the voltage division by the resisters R6 and R7. The amplifier gain could thus be increased and the drop in sound pressure when the system is used as a non-directional speaker system could be thereby compensated.

The test examples described above are not intended to limit the scope of the present invention. For example, the output characteristic need not be compensated by a tone-control circuit contained in an amplifier. The same effect may be obtained by using a graphic equalizer whereby the playback frequency range is divided into a large number of channels and level adjustments are carried out in individual channels. With a method of this kind, fine adjustments become possible according to the actual environment in which the system is used and the overall acoustic effects can be further improved.

Figure 9:
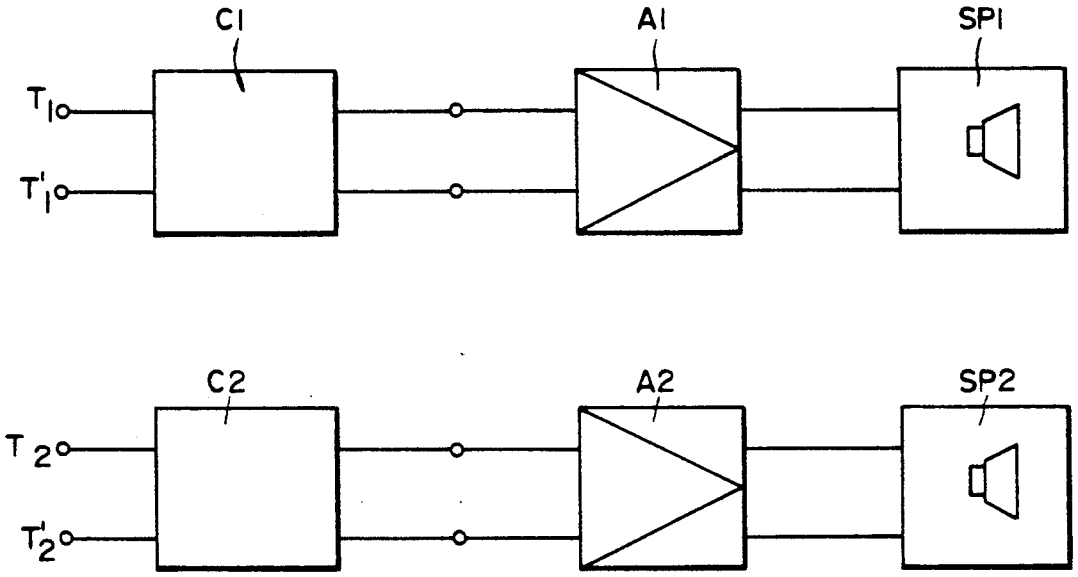
FIG. 9 is a schematic drawing for showing the connection of compensating circuits to speakers in an audio system embodying the present invention.

A manner in which the speaker units and the compensating circuits of the present invention may be connected is illustrated schematically in FIG. 9 wherein SP1 and SP2 indicate two speakers for right and left channels, and A1 and A2 indicate amplifiers driving these speakers and connected to compensating circuits C1 and C2, respectively, for correcting the output levels and frequency characteristics of the channels when the diffuser 3 is used for each channel. $T_1$, $T'_1$, $T_2$ and $T'_2$ represent sound signals for the left and right channels.

In summary, an audio system according to the present invention is comprised of a multi-channel amplifier and two or more speaker units containing speakers which are individually driven by the outputs from this multi-channel amplifier. A diffuser is detachably attached to the speaker unit opposite to the speaker and the amplifier includes a compensating circuit which can correct the output level and frequency characteristic for each channel. Sound waves from the speaker are diffused by the reflecting surface of the diffuser and propagate radially in a plane perpendicular to the central axis of the speaker. Accordingly, an audio system of a simple structure with a non-directional speaker system is realized by pointing the central axis of the speaker of this system in upward direction. Any modifications or variations which may be apparent to a person skilled in the art are intended to be included within the scope of this invention.

What is claimed is:

1. An audio system to which sound signal is inputted and which outputs sound according to said sound signal, comprising a speaker unit, an amplifier circuit, and a compensating circuit, said speaker unit comprising:

a housing having a front surface provided with an opening, a first surface and a second surface such that said housing can be put on a floor with said first surface facing downward while said front surface facing upward and that said housing can be put on said floor with said second surface facing downward while said front surface facing horizontally;

a speaker contained in said housing and disposed at said opening; and a diffuser comprising a base plate having a convex reflector surface and means for detachably attaching said base plate to said housing, said base plate being positioned parallel to said front surface with said convex reflector surface protruding toward said speaker when said base plate is attached to said housing, said amplifier circuit receiving said sound signal through said compensating circuit and driving said speaker according to said received sound signal, said compensating circuit including switch means and first and second resister networks which are adapted to compensate for low and high frequencies of said sound signal respectively, said switch means being adapted to establish various characteristic curves for said sound signal by shorting out various resisters in said first and second resister networks so as to provide greater degrees of compensation for said sound signal, wherein said housing is put on said floor with said front surface facing upward with said diffuser attached, while said housing is put on said floor with said front surface facing horizontally without said diffuser.

2. An audio system according to claim 1, wherein said convex reflector surface has a central axis such that sound waves incident along said central axis upon said convex reflector surface are deflected by 90 degrees to propagate radially.

3. An audio system according to claim 2, wherein said central axis is in coaxial relationship with said speaker.

4. An audio system according to claim 1, wherein said base plate has a flat plane at an opposite side of said convex reflector surface for loading an object thereon during a non-directional mode operation.

5. An audio system according to claim 1, wherein said convex reflector surface has an apex, said apex being at a specified distance in front of said speaker.

6. An audio system according to claim 5, wherein said detachably attaching means comprises pipe-shaped members, said pipe-shaped members being attached to said base plate and adapted to detachably attach to said housing to maintain said specified distance.

7. An audio system according to claim 1, wherein said diffuser comprises a synthetic resin material and is formed unistructurally.

8. An audio system according to claim 1, wherein said compensating circuit includes means for adjusting the amount of compensation.

9. An audio system according to claim 1, wherein said compensating circuit is adapted to individually adjust gains in a low frequency range and a high frequency range.

10. An audio system to which sound signal is inputted and which outputs sound according to said sound signal, comprising a plurality of speaker units and a multi-channel amplifier unit, each of said speaker units comprising:

a housing having a front surface provided with an opening, a first surface and a second surface such that said housing can be put on a floor with said first surface facing downward while said front surface facing upward and that said housing can be put on said floor with said second surface facing downward while said front surface facing horizontally;

a speaker contained in said housing and disposed at said opening; and a diffuser comprising a base plate having a convex reflector surface and means for detachably attaching said base plate to said housing, said base plate being positioned parallel to said front surface with said convex reflector surface protruding toward said speaker when said base plate is attached to said housing, said multi-channel amplifier unit comprising a plurality of sets of an amplifier circuit and a compensating circuit, said amplifier circuit receiving said sound signal through said compensating circuit and driving each of said speaker according to said received sound signal, said compensating circuit including switch means and first and second resister networks which are adapted to compensate for low and high frequencies of said sound signal respectively, said switch means being adapted to establish various characteristic curves for said sound signal by shorting out various resisters in said first and second resister networks so as to provide greater degrees of compensation for said sound signal, wherein said housing is put on said floor with said front surface facing upward with said diffuser attached, while said housing is put on said floor with said front surface facing horizontally without said diffuser.

* * * * *